United States Patent [19]

Minnick

[11] Patent Number: 4,584,923

[45] Date of Patent: Apr. 29, 1986

[54] SELF TUNING TAIL PIECE FOR STRING INSTRUMENTS

[76] Inventor: Gregory B. Minnick, 12740 NW. 2nd Ave., North Miami Beach, Fla. 33168

[21] Appl. No.: 708,547

[22] Filed: Mar. 5, 1985

[51] Int. Cl.[4] ..... G10G 7/02; G10H 3/00

[52] U.S. Cl. ..... 84/454; 84/1.16

[58] Field of Search ..... 84/454–460, 84/1.01, 1.16; 324/79 R; 73/862.42

[56] References Cited

U.S. PATENT DOCUMENTS 4,018,124 4/1977 Rosado ..... 84/1.16

4,088,052 5/1978 Hedrick ..... 84/454

4,375,180 3/1983 Scholz ..... 84/454

*Primary Examiner*—Douglas S. Lee

*Attorney, Agent, or Firm*—Jesus Sanchelima

[57] ABSTRACT

An automatic tuning device for guitars and string instruments in general having a string tensioning mechanism adapted to vary the tension of the strings from the tail piece in response to the differences detected between the reference signals and the string signal produced. A reversible D.C. motor provides the rotational motion that is translated into a proportional linear motion that is used to either pull or release each one of the strings.

3 Claims, 3 Drawing Figures

SELF TUNING TAIL PIECE FOR STRING INSTRUMENTS

BACKGROUND OF THE INVENTION

1. Field of the Invention

This invention relates to tuning apparatus for string instruments, and more particularly, to such devices that are automatically tuned by simply striking the string being tuned.

2. Description of the Prior Art

Musicians need to constantly tune their instruments because of the changing physical conditions and characteristics of the materials of which those instruments are made, specially string instruments. Prior to a performance, it is not unusual to see musicians adjusting their instruments under non-optimal conditions, noise, darkness, distracting audiences, etc. Furthermore, beginners usually have a hard time tuning their instruments, and sometimes, it takes a considerably amount of practice to master this task.

The closest disclosure resolving this problem corresponds to U.S. Pat. No. 4,088,052 issued to W. David Hedrick in 1978. Hedrick's device is not a completely automatic device since the user has to monitor the reading of meter 16, rotate knob 20 and, more important, the device requires the mechanical connection of flexible shaft 28 to each one of the string mechanisms. Here, we have a tuning device that is self-contained in the string instrument and requires no manipulation of controls other than striking the string to be tuned.

Another attempt to solve this problem is documented in U.S. Pat. No. 4,018,124 issued to Ruperto L. Rosado in 1977. In his disclosure, the patentee describes a circuit for generating a master reference signal from which the standard tones are derived and compared to the electric signals produced by the different strings and lighting elements indicate when the user has achieved the necessary tension on each string that matches the reference tone. However, the user must use both hands as if he were tuning the instrument conventionally, which is something that the present invention avoids. Not only that, but the user of this invention does not have to pay attention to complicated gauges in order for him to tune his instrument.

Other patents describing the closest subject matter provide for a number of more or less complicated features that fail to solve the problem in an efficient and economical way. None of these patents suggest the novel features of the present invention.

SUMMARY OF THE INVENTION

It is the main object of the present invention to provide an automatic tuning device for string instruments that would only require the user to strike the strings in order for the proper tuning of the device to be achieved.

Another object of the present invention is to provide an automatic tuning device that automatically stimulates and tunes each string.

It is still another object of this invention to provide a device that is contained within the instrument and that it is simple, reliable and easy to maintain.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
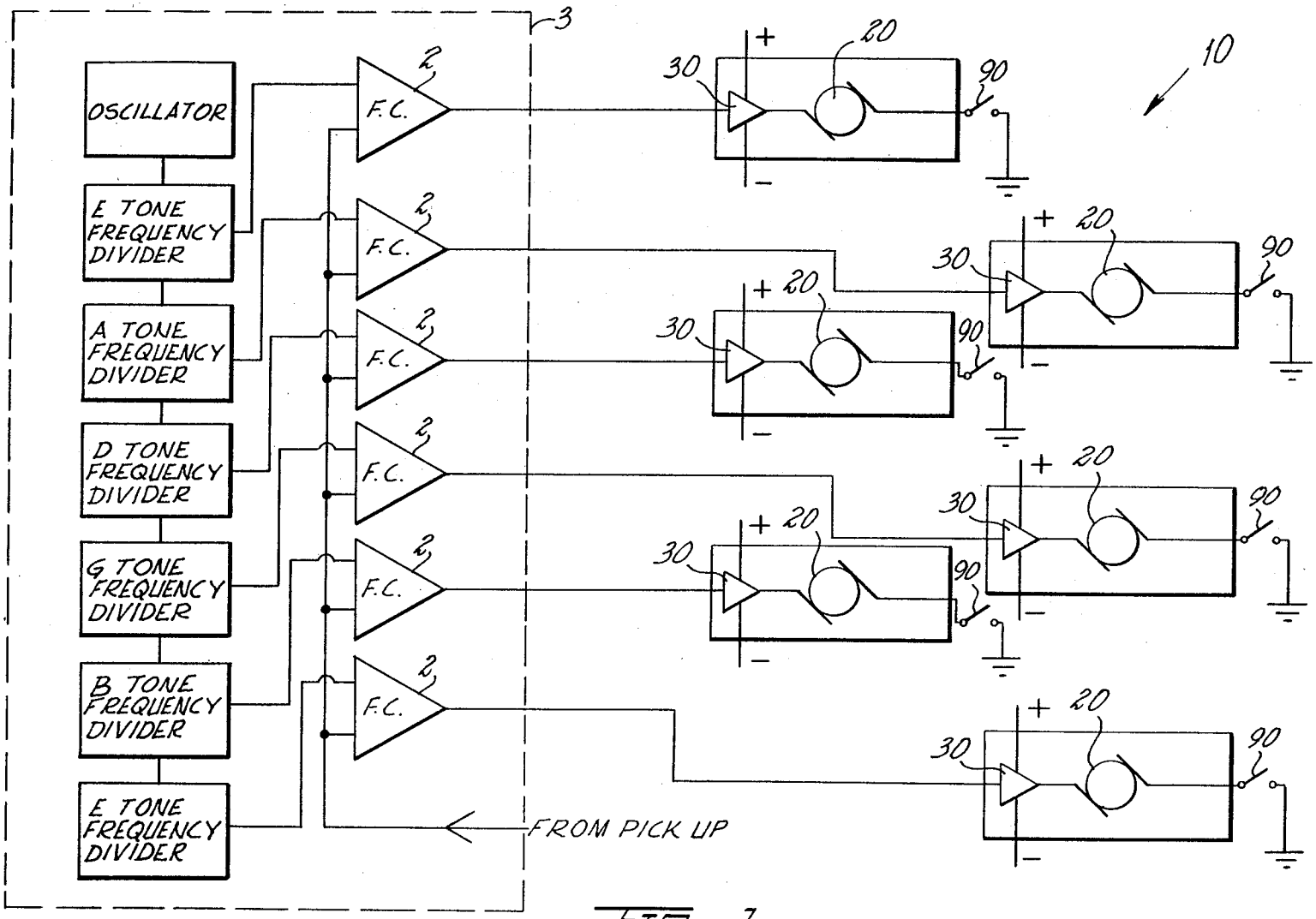
FIG. 1 illustrates a block diagram showing conventional electronic circuitry for generating standard reference tones and comparing it with the tones generated by the strings.

Referring now to FIG. 1, where the present invention is generally referred to with numeral 10, it can be seen that the electronic circuitry 3 contained within the broken line corresponds to a conventional circuit for generating reference tones against which the signals from a pick up are compared. The outputs from comparators 2 are fed to motor drivers 30 which in the preferred embodiment are bipolar operational amplifiers. The outputs of drivers 30 are connected to motors 20 which are, in the preferred embodiment, reversible D.C. motors with permanent magnets. The motors 20 are mechanically coupled to the tail piece string tensioning mechanisms shown in FIGS. 2 and 3.

Motor drivers 30 are fed with the proper dual polarity voltage levels so that either a positive or negative output signal is generated. The magnitude of this output signal being proportional to the difference between the reference signal coming from the pick up and the particular reference fed to a given comparator 2.

Switches 90 are normally open single throw switches that can be ganged together interlockingly so that only one switch 90 is closed at a given time thereby enabling one motor 20 at a time only. These ganged switches are similar to those pushbutton switch assemblies used in automobile radios.

When automatic tuning device 10 is in operation, the outputs of comparators 2 will feed signals to drivers 30 but only the motor 20 having its corresponding switch 90 activated will be driven. Therefore, only the tension in that particular string associated with that motor will be changed. Another way of accomplishing basically the same thing would be to change the interrupting function of switch 90 from the ground of motor 20 to, for instance, interrupt the dual polarity voltages of driver 30, or to interrupt the output of either driver 30 or comparator 2. The objective, however, would be the same, namely, to interrupt the driving of all motors 20 except the one for which the string being tuned is being activated.

Different manners of striking or stimulating the strings may be designed instead of manually plucking them. For instance, small hammers (not shown) may be programmed to sequentially hit the strings thereby minimizing the effort required from the musician. Another manner of activating the strings would be by generating a reference signal that in turn would make a resonant string vibrate and then, after the reference signal is shut off, the sound of the string so activated is converted to an electric signal through a pick up which is then compared with appropriate reference as mentioned above.

Many other ways of changing the manner in which the musician gets involved in tuning his instrument with the present invention may be designed and they would be considered within the general realm of engineering knowledge.

Figure 2:
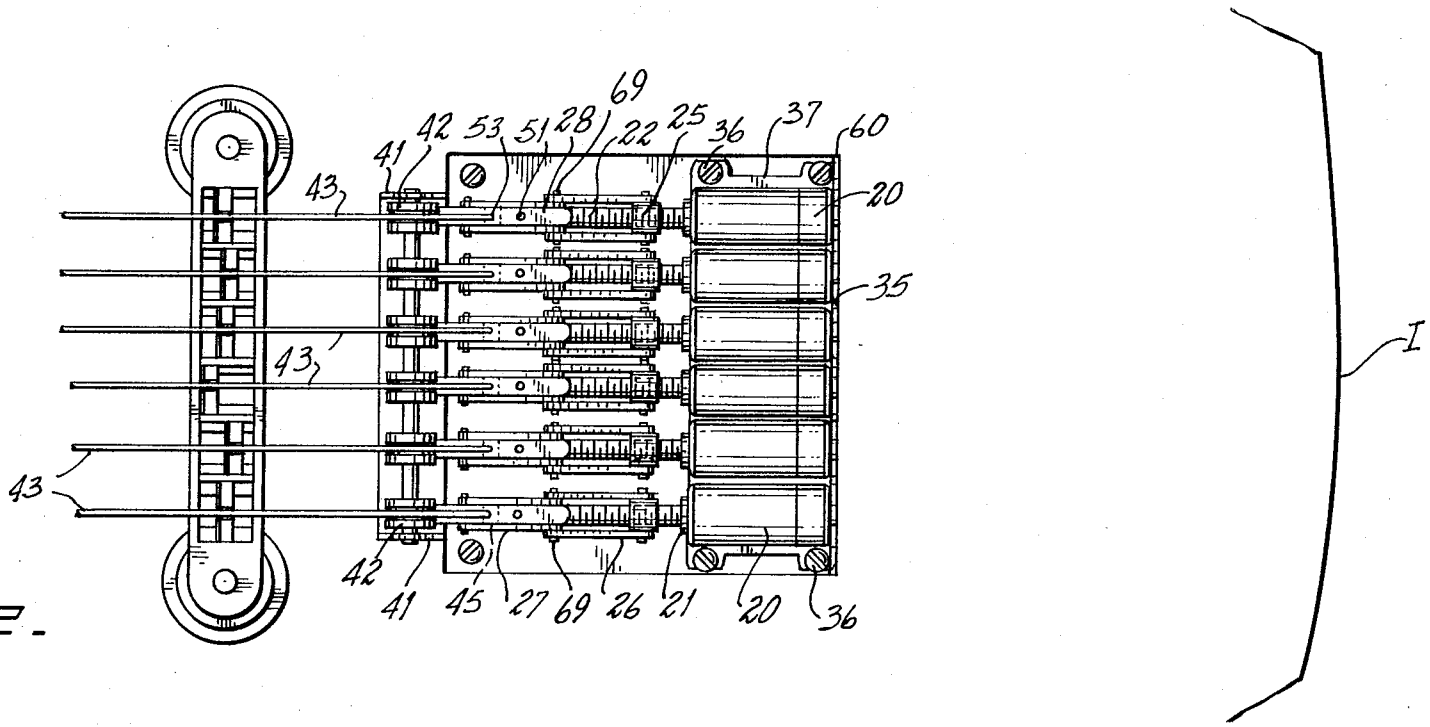
FIG. 2 shows a top view of the tail piece mechanism for each string of a guitar.
Figure 3:
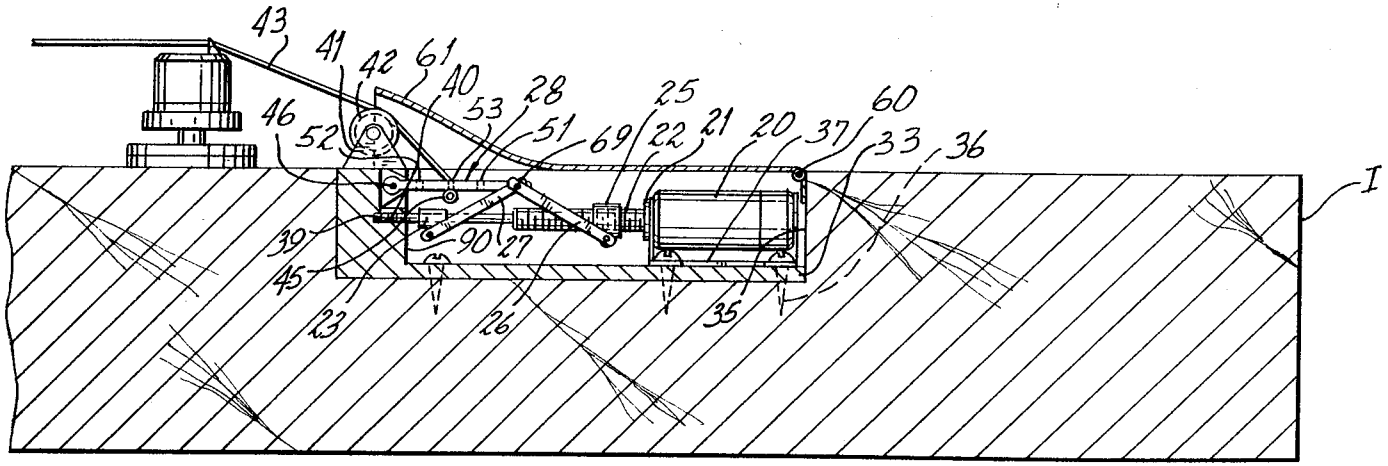
FIG. 3 is an elevational side view of one of the string mechanisms.

In FIG. 2, it can be observed that each string has one motor 20 driving one tail piece string mechanism. Motor 20 is mounted inside compartment 35 of the instrument I through wood screws 36 holding motor bracket 37 and base plate 33 in place. Motor shaft 39 extends across compartment 35 into bearing 40 for structural and mechanical integrity. Threaded sleeve 22 is rigidly mounted over shaft 39, thereby following its rotational movement. Moving nut 25 moves along the horizontal axis in response to the rotation of sleeve 22. Slider 23 freely slides over shaft 39. First arm 26 is pivotally connected to nut 25 on one end and the other end is pivotally connected at 69 to one end of second arm 27 and third arm 28. The other end of arm 27 is pivotally connected to slider 23. The other end of arm 28 is pivotally mounted to a point on inner wall 90 of base plate 30 above bearing 40. Pin 46 provides the pivoting support structure for arm 28. Arm 28 has holes 51; 52 and 53. String 43 passes through one of these holes and is held in place by end of string ball 45. Roller 42 deflects the path of string 43. Roller support 41 is rigidly mounted to instrument I. Basically, when motor 20 is activated by a difference between reference and string signals detected by frequency comparator 2 and fed to driver 30, the rotation of motor shaft 39 and threaded sleeve 22 causes moving nut 25 to move either away or toward motor 20. Locking nut 21 is used to keep motor 20 in place with motor bracket 37. This in turn causes arms 26 and 27 to change their relative positions and, consequently, either raises or lowers arm 28 thereby relaxing or tensioning string 43. In the preferred embodiment, a hinge member 60 for cover 61 allows ready access to the string mechanism.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. An automatic tuning device for instruments having a plurality of strings and transducer means for converting the accoustic energy produced said strings to an equivalent electric signal, comprising:

A. a plurality of means for generating a plurality of reference tones corresponding to each of said plurality of strings;

B. a plurality of means for comparing said reference tones to the tones produced by said strings through said transducer means, including means for producing an electrical output signal when said tones do not match;

C. a plurality of motor means activated by said output signal, including a corresponding plurality of means for enabling one of said motor means at a time; and D. a plurality of string tensioning means mechanically connected to said strings at the tail piece of said instrument and activated by said motor means and said tensioning means including a threaded sleeve member rigidly mounted to a shaft of said motor means and a moving nut member pivotally connected through linkage arm means to the end of one of said strings so that its tension may be varied in direct proportion to rotation of said shaft;

E. motor driving means connected to said motor means.

2. The device set forth in claim 1 wherein said linkage arm means further includes a sliding member traveling along said shaft and being pivotally connected to said arm means.

3. The device set forth in claim 2 wherein said means for enabling one of said motor means at a time includes one normally open pushbutton switch and said switch being interlocked with the other switches of said plurality of enabling means.

* * * * *